US010553373B2

(12) United States Patent
Mori et al.

(10) Patent No.: US 10,553,373 B2
(45) Date of Patent: Feb. 4, 2020

(54) POWER SWITCHING CONTROL DEVICE

(71) Applicant: Mitsubishi Electric Corporation, Chiyoda-ku, Tokyo (JP)

(72) Inventors: Tomohito Mori, Tokyo (JP); Aya Yamamoto, Tokyo (JP); Daisuke Yoshida, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 266 days.

(21) Appl. No.: 15/548,006

(22) PCT Filed: Mar. 5, 2015

(86) PCT No.: PCT/JP2015/056533
§ 371 (c)(1),
(2) Date: Aug. 1, 2017

(87) PCT Pub. No.: WO2016/139803
PCT Pub. Date: Sep. 9, 2016

(65) Prior Publication Data
US 2018/0033570 A1 Feb. 1, 2018

(51) Int. Cl.
*H01H 9/56* (2006.01)
*H01H 33/59* (2006.01)

(52) U.S. Cl.
CPC ..... *H01H 9/56* (2013.01); *H01H 33/59* (2013.01)

(58) Field of Classification Search
CPC ..... H01H 9/56; H01H 33/59
(Continued)

(56) References Cited

U.S. PATENT DOCUMENTS 6,433,980 B1 8/2002 Tsutada et al.
2007/0133140 A1* 6/2007 Vicente ..... H02H 3/08 361/94
(Continued)

FOREIGN PATENT DOCUMENTS

JP 2010-244780 A 10/2010
JP 2012-59447 A 3/2012
(Continued)

OTHER PUBLICATIONS

International Search Report (PCT/ISA/210) dated Mar. 31, 2015, by the Japanese Patent Office as the International Searching Authority for International Application No. PCT/JP2015/056533.
(Continued)

*Primary Examiner* — Zeev V Kitov
(74) *Attorney, Agent, or Firm* — Buchanan, Ingersoll & Rooney PC

(57) ABSTRACT

A power switching control device includes a voltage measurement unit to measure a power-source-side voltage of a circuit breaker and a load-side voltage of the circuit breaker, an inter-pole-voltage estimation unit to estimate a future inter-pole voltage from a value of the power-source-side voltage and a value of the load-side voltage, a target closing-clock-time determination unit to set a target activation point of the circuit breaker on a waveform of an absolute value of the future inter-pole voltage, set an inter-pole withstand-voltage characteristic line calculated from a rate of decrease of dielectric strength, so that the inter-pole withstand-voltage characteristic line passes through the target activation point, and determine a clock time when the inter-pole withstand-voltage characteristic line becomes zero as a target closing clock time of the circuit breaker, and a closing control unit to close the circuit breaker at the target closing clock time.

4 Claims, 4 Drawing Sheets

(58) Field of Classification Search
USPC ..... 361/211
See application file for complete search history.

(56) References Cited

U.S. PATENT DOCUMENTS

| | | | | |
|---|---|---|---|---|
| 2009/0108967 | A1* | 4/2009 | Parker | H02H 1/0015 335/20 |
| 2010/0110600 | A1* | 5/2010 | Saito | H01H 9/563 361/98 |
| 2010/0254060 | A1* | 10/2010 | Saito | H01H 9/56 361/115 |
| 2013/0221760 | A1 | 8/2013 | Mori et al. | |
| 2016/0225548 | A1 | 8/2016 | Mori et al. | |

FOREIGN PATENT DOCUMENTS

| | | | |
|---|---|---|---|
| JP | 5579340 | B1 | 8/2014 |
| WO | WO 2012/095958 | A1 | 7/2012 |
| WO | WO 2015/056289 | A1 | 4/2015 |

OTHER PUBLICATIONS

Written Opinion (PCT/ISA/237) dated Mar. 31, 2015, by the Japanese Patent Office as the International Searching Authority for International Application No. PCT/JP2015/056533.

* cited by examiner

POWER SWITCHING CONTROL DEVICE

FIELD

The present invention relates to a power switching control device that controls switching of a power switchgear.

BACKGROUND

During a switching operation of a circuit breaker, an overvoltage or an inrush current may occur and affect a system. Therefore, a power switching control device that controls switching of a circuit breaker in a phase where an overvoltage or an inrush current can be suppressed is conventionally used.

At the time of activation of a circuit breaker, before the contacts are mechanically brought into contact with each other, pre-arcing due to dielectric breakdown occurs between contacts of the circuit breaker and the contacts are conducted with each other. Therefore, when the circuit breaker is to be activated, it is necessary to set the phase of an electrical activation point as a target phase and predict a pre-arcing time to determine a target closing clock time. The pre-arcing time is a duration time of pre-arcing.

In a conventional power switching control device, the pre-arcing time at the time of activation of a circuit breaker is calculated from a rate of decrease of dielectric strength (RDDS) of the circuit breaker and a system voltage. The RDDS is assumed to be a constant value (Patent Literature 1).

CITATION LIST

Patent literature

Patent Literature 1: Japanese Patent Application Laid-open No. 2010-244780

SUMMARY

Technical Problem

The RDDS generally depends on a mechanical property and an electrical property of a circuit breaker. The mechanical property is a moving velocity v of a movable contact of the circuit breaker, and the electrical property is a flashover voltage Vf and an inter-pole distance d being a distance between contacts. Specifically, the RDDS is represented by $(Vf/d)\times v$. Therefore, even if the flashover voltage Vf is constant, the RDDS depends on the time t through v(t) when the moving velocity v of the movable contact depends on a time t. The moving velocity v of the movable contact actually depends on the time t.

However, in the conventional power switching control device, the RDDS is calculated as a constant value from results of measurement of an electrical activation point and a mechanical activation point (Patent Literature 1). Accordingly, although the actual RDDS is a function of the time, the target closing clock time is determined based on the RDDS calculated as a constant value. If a circuit breaker is closed at the target closing clock time, the phase of an actual electrical activation point deviates from the target phase, which reduces the accuracy of phase control.

The present invention has been achieved in view of the above problem, and an object of the present invention is to provide a power switching control device capable of improving the accuracy of phase control.

Solution to Problem

In order to solve the problems and achieve the object, according to an aspect of the present invention, there is provided a power switching control device including: a voltage measurement unit to measure a power-source-side voltage of a circuit breaker and a load-side voltage of the circuit breaker; an inter-pole-voltage estimation unit to estimate a future inter-pole voltage from a measurement value of the power-source-side voltage and a measurement value of the load-side voltage; a target closing-clock-time determination unit to set a target activation point of the circuit breaker on a waveform of an absolute value of the future inter-pole voltage, set an inter-pole withstand-voltage characteristic line calculated from a rate of decrease of dielectric strength, the rate being a function of a time, so that the inter-pole withstand-voltage characteristic line passes through the target activation point, and determine a clock time when the inter-pole withstand-voltage characteristic line becomes zero as a target closing clock time of the circuit breaker; and a closing control unit to control the circuit breaker so as to close the circuit breaker at the target closing clock time.

Advantageous Effects of Invention

According to the present invention, an effect is obtained where it is possible to provide a power switching control device capable of improving the accuracy of phase control.

DESCRIPTION OF EMBODIMENTS

Exemplary embodiments of a power switching control device according to the present invention will be explained below in detail with reference to the accompanying drawings. The present invention is not limited to the embodiments.

Embodiment

Figure 1:
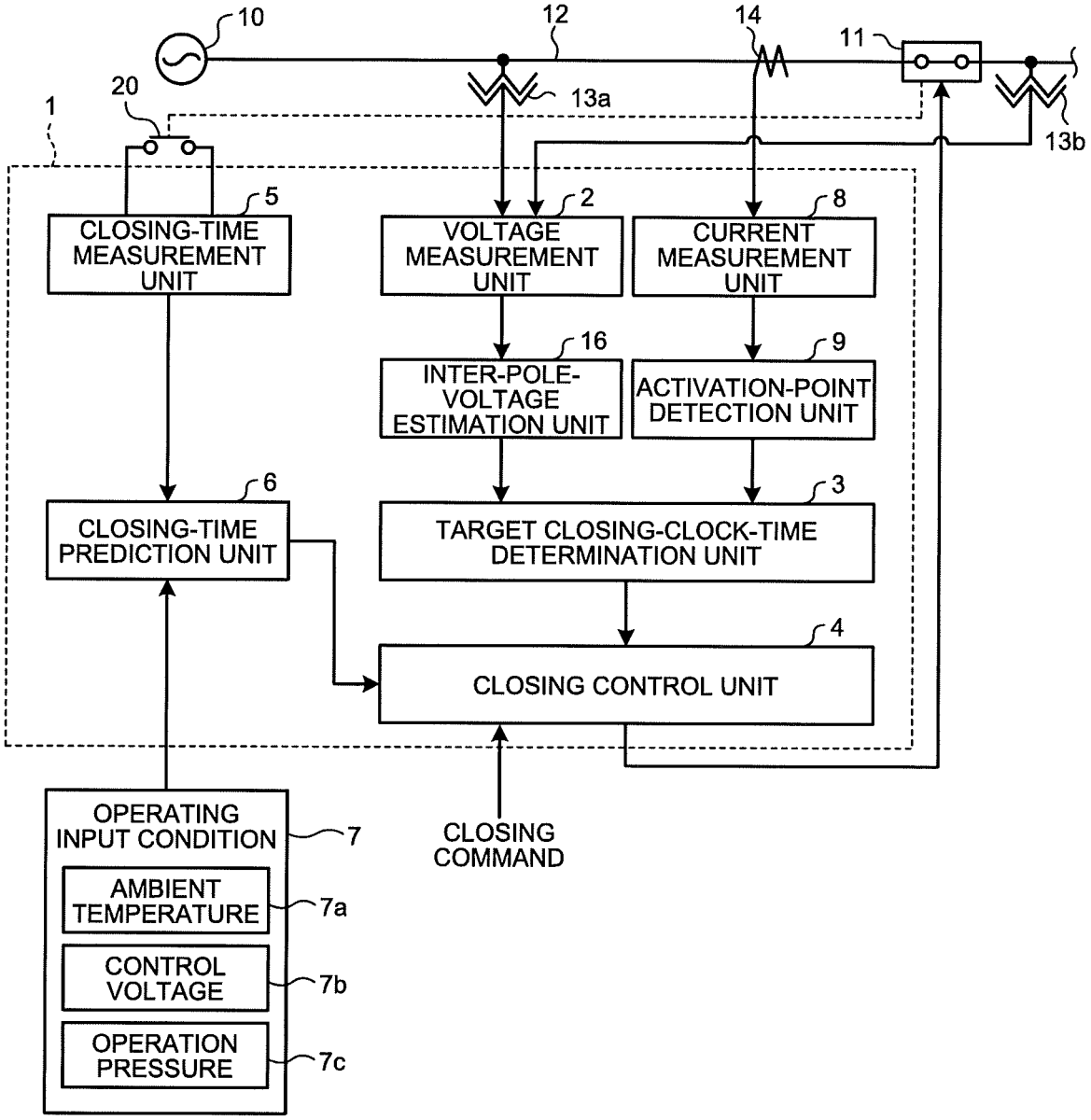
FIG. 1 is a diagram illustrating a configuration of a power switching control device according to an embodiment.

FIG. 1 is a diagram illustrating a configuration of a power switching control device 1 according to an embodiment of the present invention. As illustrated in FIG. 1, the power switching control device 1 is connected to a circuit breaker 11 serving as a power switchgear. The circuit breaker 11 is, for example, a gas circuit breaker. The circuit breaker 11 is connected to a system power source 10 via a main circuit 12. The system power source 10 is a three-phase AC power source. In FIG. 1, only a configuration corresponding to one phase among the three phases is illustrated and illustrations of the remaining two phases are omitted.

The power switching control device 1 includes a voltage measurement unit 2 that measures a power-source-side voltage, which is a voltage between the system power source 10 and the circuit breaker 11, and a load-side voltage of the circuit breaker 11, an inter-pole voltage estimation unit 16 that estimates a future inter-pole voltage from a difference between the power-source-side voltage measured by the voltage measurement unit 2 and the load-side voltage measured by the voltage measurement unit 2, a current measurement unit 8 that measures a current of the main circuit 12, an activation-point detection unit 9 that detects an activation clock time from a current measurement value of the current measurement unit 8, a closing-time measurement unit 5 to which an auxiliary switch 20 working with a movable contact (not illustrated) of the circuit breaker 11 is connected, and that measures a closing time of the circuit breaker 11 by detecting a closing clock time of the circuit breaker 11, a closing-time prediction unit 6 that predicts a closing time of the circuit breaker 11, a target closing-clock-time determination unit 3 that determines a target closing clock time for closing the circuit breaker 11 in a target phase using the inter-pole voltage estimated by the inter-pole-voltage estimation unit 16 and a rate of decrease of dielectric strength provided in advance, and a closing control unit 4 that controls the circuit breaker 11 to close the circuit breaker 11 at the target closing clock time output from the target closing-clock-time determination unit 3 when a circuit breaking command is received from outside.

In the following descriptions, simple reference to "activation" means electrical activation, and simple reference to "activation point" means an electrical activation point. Electrical activation indicates conduction between contacts of the circuit breaker 11. Further, "closing" means mechanical activation and "closing point" means a mechanical activation point. Mechanical activation indicates that the contacts of the circuit breaker 11 are mechanically brought into contact with each other.

The voltage measurement unit 2 measures a power-source-side voltage of the circuit breaker 11 via a voltage transformer 13*a* that detects a voltage of the main circuit 12 between the system power source 10 and the circuit breaker 11. The power-source-side voltage is a system voltage depending on the system power source 10. The voltage measurement unit 2 also measures a load-side voltage of the circuit breaker 11 via a voltage transformer 13*b*. The load side of the circuit breaker 11 is a side to which a load (not illustrated) is connectable and is the opposite side to the power source side. The current measurement unit 8 measures a current of the main circuit 12 via a current transformer 14 that detects a current of the main circuit 12 connected to the circuit breaker 11. The activation-point detection unit 9 monitors a current measurement value of the current measurement unit 8 and detects an activation clock time, which is a clock time when energization is started due to occurrence of pre-arcing. The activation-point detection unit 9 outputs a detection value of the activation clock time to the target closing-clock-time determination unit 3.

The inter-pole voltage estimation unit 16 obtains a measurement value of the inter-pole voltage, which is a difference between a measurement value of the power-source-side voltage measured by the voltage measurement unit 2 and a measurement value of the load-side voltage measured by the voltage measurement unit 2, and estimates an estimation value of a future inter-pole voltage from the measurement value of the inter-pole voltage.

An example of a method for estimating a future inter-pole voltage waveform performed by the inter-pole voltage estimation unit 16 is described below. In this estimation method, a future inter-pole voltage waveform y(t) is estimated as a synthetic waveform of a plurality of frequencies represented by the following expression.

[Expression 1]

$$y(t) = \sum_{i=1}^{M} A_i \exp(\sigma_i t)\cos(2\pi f_i t + \phi_i) \tag{1}$$

where $A_i$, $\sigma_i$, $f_i$, and $\phi_i$ are waveform parameters. Specifically, $A_i$ is an amplitude, $\sigma_i$ is an attenuation rate, $f_i$ is a frequency, and $\phi_i$ is a phase. Further, t is a time, M is the number of frequency components and is set in advance, and i takes an integer value from 1 to M.

The total number of waveform parameters in the expression (1) is (4×M). By determining all these waveform parameters using a measurement value of the inter-pole voltage, the future inter-pole voltage waveform y(t), that is, an estimation value of the inter-pole voltage at an arbitrary time t can be obtained. Specifically, the inter-pole voltage estimation unit 16 determines the waveform parameters in the expression (1) by a least-square method using n measurement values of the inter-pole voltage. The n measurement values of the inter-pole voltage are measurement values at different n clock times in the past and n≥4×M is established. The waveform parameters can be determined using a method other than the least-square method. For example, when a matrix pencil method is used, the calculation time is reduced and also the calculation accuracy is improved.

The inter-pole voltage estimation unit 16 outputs the estimation value of the future inter-pole voltage estimated in the manner described above to the target closing-clock-time determination unit 3. The target closing-clock-time determination unit 3 is described later.

The closing-time prediction unit 6 predicts a closing time based on an operating input condition 7 of the circuit breaker 11. The operating input condition 7 includes an ambient temperature 7*a* of the circuit breaker 11, a control voltage 7*b* of the circuit breaker 11, and an operation pressure 7*c* of the circuit breaker 11. In other words, the closing time depends on the ambient temperature 7*a*, the control voltage 7*b*, and the operation pressure 7*c*. The closing-time prediction unit 6 has stored therein in advance information related to a reference closing time corresponding to reference values of the ambient temperature 7*a*, the control voltage 7*b*, and the operation pressure 7*c*, and a deviation of the closing time from the reference closing time, corresponding to deviations from the reference values of the ambient temperature 7*a*, the control voltage 7*b*, and the operation pressure 7*c*. The closing-time prediction unit 6 calculates differences between the ambient temperature 7*a*, the control voltage 7*b*, and the operation pressure 7*c* and the reference values thereof and correct the reference closing time to predict the closing time.

The closing time also changes depending on an operation history of the circuit breaker 11, including wear of contacts and deteriorations with the time. The closing-time prediction unit 6 obtains an error between a past actual closing time and the predicted closing time and corrects the closing time predicted based on the operating input condition 7 so as to eliminate the error. The past actual closing time is obtained from the closing-time measurement unit 5.

The closing time is a time from when the movable contact of the circuit breaker 11 starts the operation to when the circuit breaker 11 is closed.

The closing-time measurement unit 5 calculate a difference between a clock time when a closing control signal is output from the closing control unit 4 and a closing clock time of the circuit breaker 11 determined by an operation clock time of the auxiliary switch 20, so as to measure the closing time. The operation clock time of the auxiliary switch 20 is a clock time when the auxiliary switch 20 changes an opening/closing state along with closing of the circuit breaker 11. The closing-time measurement unit 5 outputs a measurement value of the closing time to the closing-time prediction unit 6.

When a closing command is input, the closing control unit 4 outputs a closing control signal for closing the circuit breaker 11 at a clock time before the target closing clock time by the predicted closing time.

Figure 2:
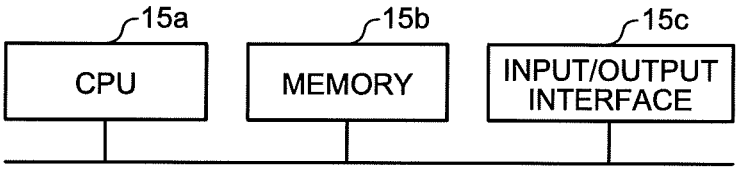
FIG. 2 is a block diagram illustrating a hardware configuration of the power switching control device.

The power switching control device 1 can be realized by a computer. FIG. 2 is a block diagram illustrating a hardware configuration of the power switching control device 1. As illustrated in FIG. 2, the power switching control device 1 is configured to include a CPU 15*a*, a memory 15*b*, and an input/output interface 15*c*.

The rate of decrease of dielectric strength (RDDS) of the circuit breaker 11 is a rate of decrease of dielectric strength between poles, that is, between contacts of the circuit breaker 11. The rate of decrease of dielectric strength is referred to as "RDDS" below. The RDDS is represented by (Vf/d)×v, where Vf is a flashover voltage, d is an inter-pole distance, and v is a moving velocity of a movable contact. In the present embodiment, it is assumed that the moving velocity v is a function of the time t and that the RDDS depends on the time t because of a time dependency of v(t). RDDS(t) is provided in advance to the target closing-clock-time determination unit 3. RDDS(t) indicates that the RDDS is a function of the time t. In this case, RDDS(t) is provided for a time range from a clock time when the movable contact starts moving to a clock time when the inter-pole distance d becomes zero. RDDS(t) can be calculated using an actual measurement value of v(t), where v(t) depends on the circuit breaker 11.

Figure 3:
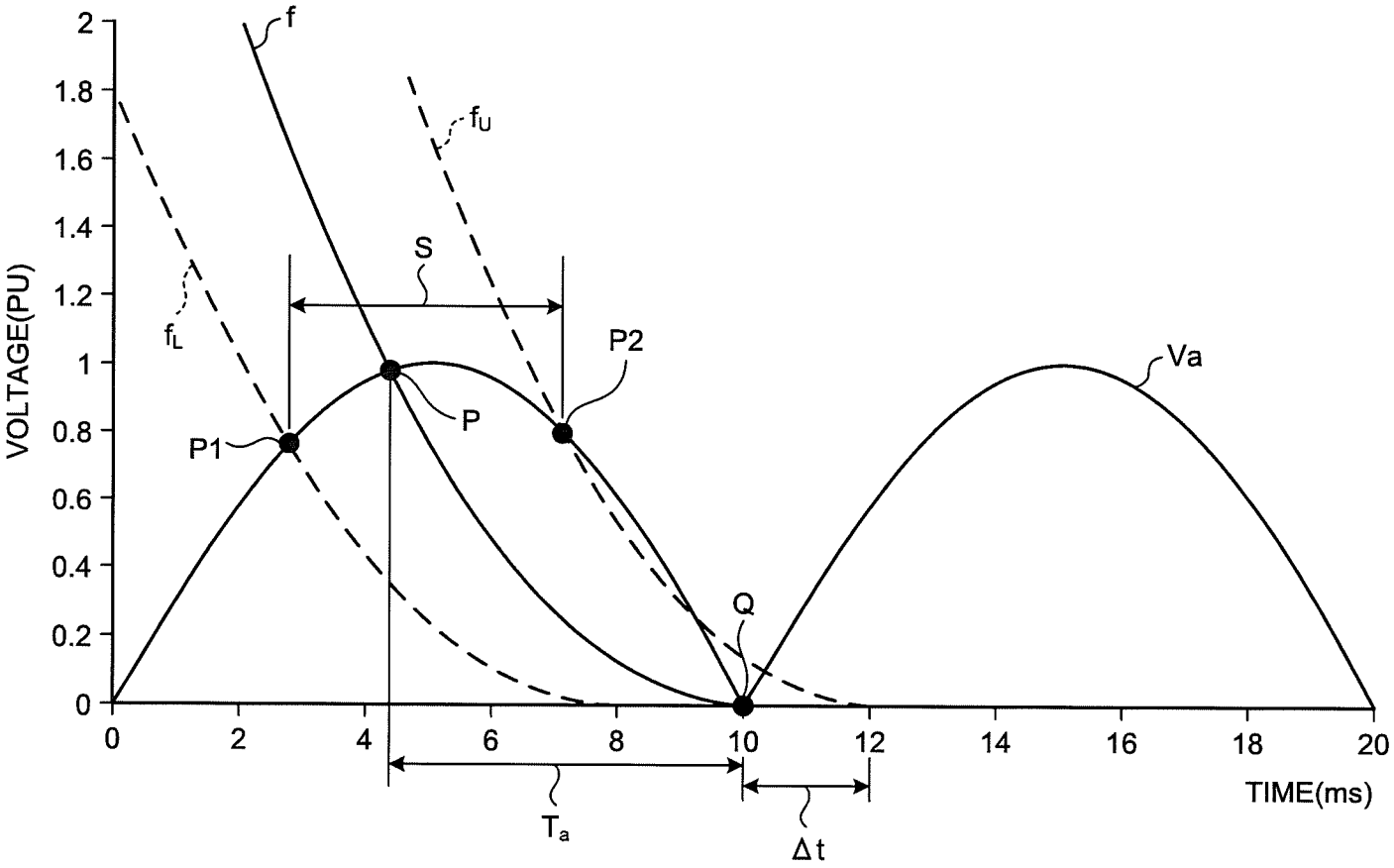
FIG. 3 is an explanatory diagram of a method for determining a target closing clock time performed by a target closing-clock-time determination unit.

FIG. 3 is an explanatory diagram of a method for determining the target closing clock time performed by the target closing-clock-time determination unit 3. In FIG. 3, the horizontal axis represents the time (ms) and the vertical axis represents the voltage (PU). PU indicates a value based on a rated voltage.

Va represents a waveform of the absolute value of an estimated inter-pole voltage. Because a case where the load-side voltage is zero is illustrated as an example, the inter-pole voltage is provided by the power-source-side voltage. The line f represents an inter-pole withstand-voltage characteristic line and the slope of the tangent line of the line f provides the RDDS. That is, the absolute value of a temporal differentiation of f(t) provides RDDS(t). Because the RDDS has a time dependency as described above, the line f does not become a straight line. Furthermore, f(t) can be calculated from RDDS(t).

P denotes a target activation point. The target activation point P is a point on the waveform Va, which is determined by a target phase when activation is performed. The target phase is determined in advance. In the illustrated example, the target activation point P is a voltage wave crest and f(t) is determined so as to pass through the target activation point P. A target activation clock time being a clock time of the target activation point P is denoted by t1.

Q is a target closing point. The target closing point Q is determined by a clock time when f(t)=0 is established. That is, a clock time when f becomes zero is the target closing clock time. In this example, the target closing clock time is denoted by t2. Ta being a time difference between the target activation point P and the target closing point Q, that is, Ta=(t2−t1) is a pre-arcing time.

However, because variation in the closing time of the circuit breaker 11 and occurrence of pre-arcing are probabilistic events, the inter-pole withstand-voltage characteristic line f fluctuates probabilistically around an average value. Accordingly, a fluctuation range of f is indicated as a range from $f_L$ to $f_U$ assuming that fluctuations of the inter-pole withstand-voltage characteristic line f follow a normal distribution. When a standard deviation associated with fluctuations of the line f is σ, $f_L$ is a characteristic line of f−3σ and $f_U$ is a characteristic line of f+3σ. A time difference between a clock time when $f_L(t)=0$ or $f_U(t)=0$ is established and t2 represents variation Δt in the closing clock time. P1 denotes an intersection between $f_L$ and Va and P2 denotes an intersection between $f_U$ and Va. A time range between P1 and P2 represents an activation range S. The fluctuation range of f can be defined by ranges other than ±3σ.

As described above, also when the RDDS depends on the time, the target closing clock time can be calculated by obtaining the time t2 when the inter-pole withstand-voltage characteristic line f(t) passing through the target activation point P becomes zero.

An operation according to the present embodiment is described next. The inter-pole-voltage estimation unit 16 obtains a measurement value of the inter-pole voltage, which is a difference between a measurement value of the power-source-side voltage measured by the voltage measurement unit 2 and a measurement value of the load-side voltage measured by the voltage measurement unit 2, and estimates a future inter-pole voltage from the measurement value of the inter-pole voltage. That is, the inter-pole-voltage estimation unit 16 estimates a future inter-pole voltage waveform from the measurement value of the inter-pole voltage. In this case, the future inter-pole voltage waveform is estimated as a synthetic wave represented by the above expression (1). Alternatively, the inter-pole-voltage estimation unit 16 may estimate a future power-source-side voltage waveform from the measurement value of the power-source-side voltage, estimate also a future load-side voltage waveform from the measurement value of the load-side voltage, and then obtain the future inter-pole voltage waveform being a difference between the future power-source-side voltage waveform and the future load-side voltage waveform. In this case, the future power-source-side voltage waveform and the future load-side voltage waveform are estimated as synthetic waveforms represented by the above expression (1), respectively.

Next, the target closing-clock-time determination unit 3 obtains a waveform Va of the absolute value of the future inter-pole voltage from the future inter-pole voltage estimated by the inter-pole-voltage estimation unit 16, and also determines a target activation point P on the waveform Va of the absolute value of the future inter-pole voltage. The waveform Va of the absolute value of the future inter-pole voltage can be alternatively obtained by the inter-pole-voltage estimation unit 16.

Subsequently, the target closing-clock-time determination unit 3 calculates the inter-pole withstand-voltage characteristic line f passing through the target activation point P from RDDS(t), and obtains a target closing clock time being a clock time when f(t)=0 is established. The target closing-clock-time determination unit 3 outputs the target closing clock time to the closing control unit 4.

When a closing command is input from outside, the closing control unit 4 outputs a closing control signal to the circuit breaker 11 at a clock time before the target closing clock time by the predicted closing time. The predicted closing time is obtained from the closing-time prediction unit 6. Upon reception of the closing control signal, the circuit breaker 11 performs a circuit breaking operation.

As described above, in the present embodiment, the target closing-clock-time determination unit 3 sets the target activation point P of the circuit breaker 11 on the waveform Va of the absolute value of the future inter-pole voltage, sets the inter-pole withstand-voltage characteristic line f so that the inter-pole withstand-voltage characteristic line f calculated from the rate of decrease of dielectric strength (RDDS) being a function of the time passes through the target activation point P, and determines a clock time when the inter-pole withstand-voltage characteristic line f become zero as the target closing clock time of the circuit breaker 11. This enables the target closing clock time to be obtained accurately even when the RDDS depends on the time through the moving velocity v of the movable contact, and therefore the accuracy of the phase control can be improved.

Figure 4:
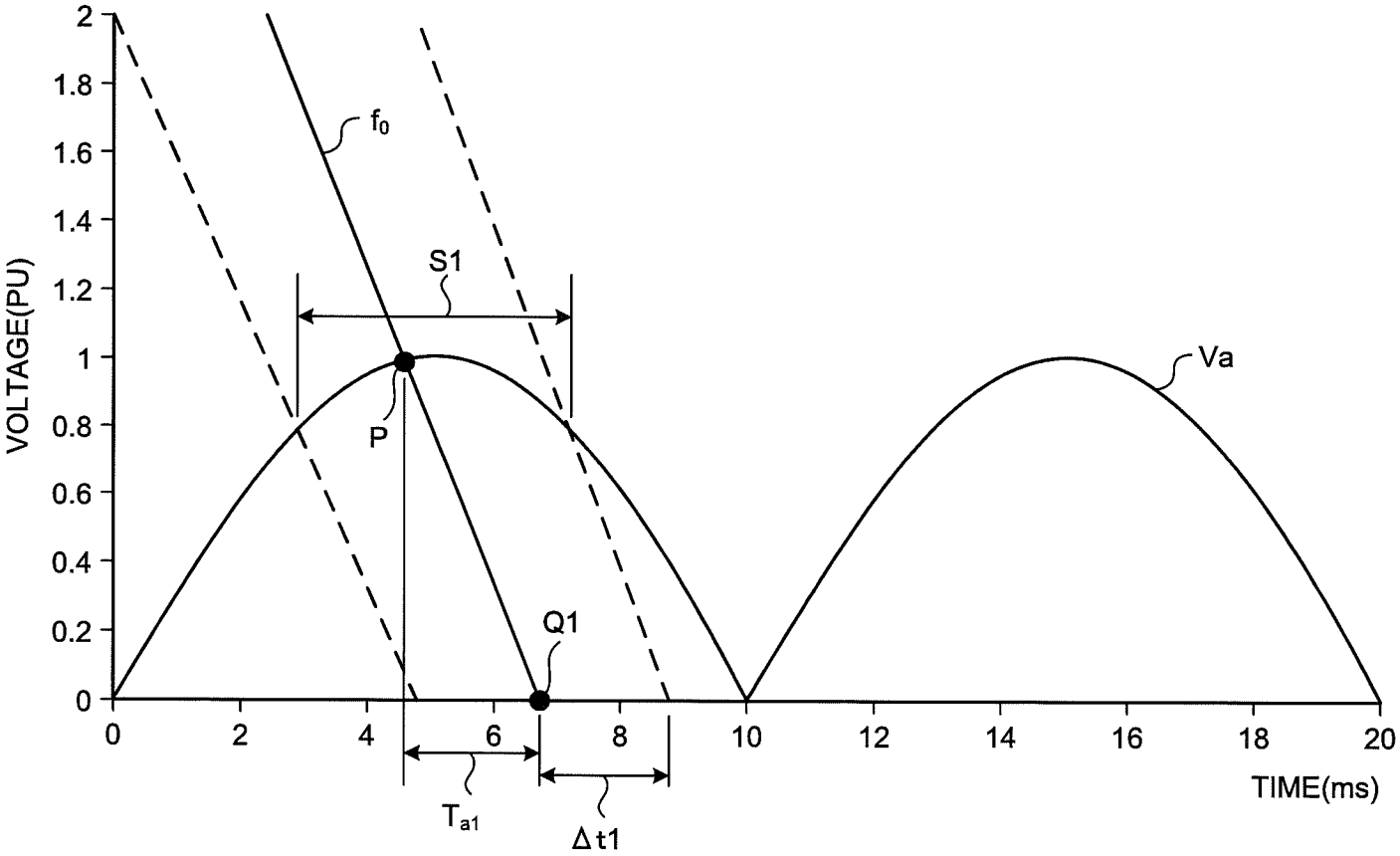
FIG. 4 is a diagram illustrating a relation between a target activation point and a target closing point in a case where an RDDS is constant.

FIG. 4 is a diagram illustrating a relation between a target activation point and a target closing point in a case where the RDDS is constant. In FIG. 4, an inter-pole withstand-voltage characteristic line $f_0$ is a straight line with a constant slope, and the absolute value of the slope is the RDDS. Va is a waveform of the absolute value of the same future inter-pole voltage as that in FIG. 3. P denotes a target activation point, Q1 denotes a target closing point, $T_{a1}$ denotes a pre-arcing time, Δt1 denotes variation in the closing clock time, and S1 denotes an activation range. The target activation point P is the same as that in FIG. 3 and is set to the voltage wave crest. When the target closing point Q1 is determined using $f_0$ in FIG. 4 while an actual inter-pole withstand-voltage characteristic line is f in FIG. 3, the target closing clock time determined by the target closing point Q1 in FIG. 4 greatly deviates from the target closing clock time determined by the target closing point Q in FIG. 3.

Figure 5:
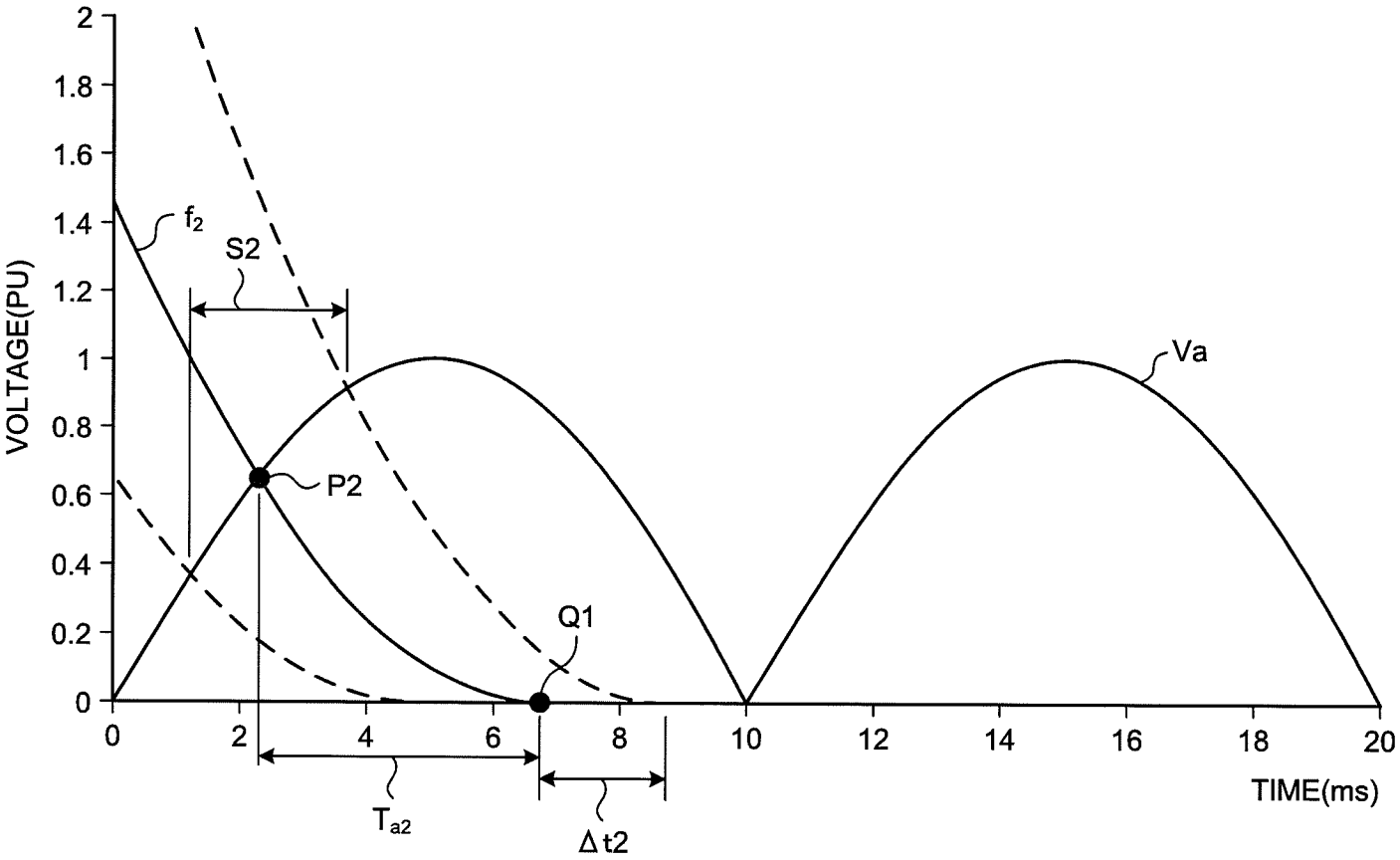
FIG. 5 is a diagram illustrating a target activation point P2 in a case where a target closing point is set to Q1 in FIG. 4 when an RDDS is the same as that in FIG. 3.

FIG. 5 is a diagram illustrating the target activation point P2 in a case where the target closing point is set to Q1 in FIG. 4 when the RDDS is the same as that in FIG. 3. An inter-pole withstand-voltage characteristic line $f_2$ is obtained by parallelly moving the line f in FIG. 3 in the time direction so as to pass through the target closing point Q1. P2 denotes a target activation point, $T_{a2}$ denotes a pre-arcing time, Δt2 denotes variation in the closing clock time, and S2 denotes an activation range. When the target closing point Q1 is determined using $f_0$ in FIG. 4, an actual electrical activation point becomes P2 in FIG. 5 and is distanced from the voltage wave crest to be greatly deviated from the target phase.

In the present embodiment described above, RDDS(t) is provided in advance. However, RDDS(t) and the inter-pole withstand-voltage characteristic line f(t) can be estimated from measurement data of the activation point and the closing point in a manner described below.

First, the RDDS being a constant value is provided as an initial value to the target closing-clock-time determination unit 3. The target closing-clock-time determination unit 3 obtains an initial inter-pole withstand-voltage characteristic line corresponding to the RDDS. The initial inter-pole withstand-voltage characteristic line is a linear function of the time, that is, a straight line.

Next, the target closing-clock-time determination unit 3 determines the target closing clock time using the initial inter-pole withstand-voltage characteristic line. The closing control unit 4 controls the circuit breaker 11 so as to close the circuit breaker 11 at the target closing clock time. The circuit breaker 11 is thus activated.

The activation-point detection unit 9 monitors a current measurement value of the current measurement unit 8 and detects a point where the current measurement value rises or falls from 0 (zero) as an activation point. That is, the activation-point detection unit 9 detects an activation clock time and outputs a detection value of the activation clock time to the target closing-clock-time determination unit 3. The target closing-clock-time determination unit 3 acquires measurement data of the activation point including the activation clock time and the absolute value of an inter-pole voltage at the activation clock time as a set. The absolute value of the inter-pole voltage at the activation clock time is obtained from a difference between a measurement value of the power-source-side voltage at the activation clock time and a measurement value of the load-side voltage at the same clock time. The closing-time measurement unit 5 detects an operation clock time of the auxiliary switch 20 as the closing clock time and outputs measurement data of the closing clock time to the target closing-clock-time determination unit 3. The target closing-clock-time determination unit 3 acquires measurement data of the closing point including the closing clock time and the voltage 0 as a set. The target closing-clock-time determination unit 3 records the measurement data of the activation point and the measurement data of the closing point at every activation.

Next, the target closing-clock-time determination unit 3 assumes a function form of the inter-pole withstand-voltage characteristic line f and then estimates the inter-pole withstand-voltage characteristic line f using the measurement data of the activation point and the measurement data of the closing point. As an example, when the inter-pole withstand-voltage characteristic line f is approximated by a quadratic function, $$f(t)=a\times t^2+b\times t+c$$

where a, b, and c are undetermined parameters.

In this case, the target closing-clock-time determination unit 3 estimates a, b, and c using the measurement data of the activation point and the measurement data of the closing point. Estimation can be performed using, for example, the least-square method. The estimation can be performed using other parameter fitting methods.

In this way, the target closing-clock-time determination unit 3 can estimate the inter-pole withstand-voltage characteristic line f from the measurement data of the activation point and the measurement data of the closing point even when an initial value of the RDDS is constant. Furthermore, the inter-pole withstand-voltage characteristic line f can be updated by periodically performing identical estimation.

The estimation or update of f(t) as described above is performed when RDDS(t) is not obtained beforehand. However, even when RDDS(t) is provided in advance, f(t) can be updated by performing identical processing to that described above.

That is, the target closing-clock-time determination unit 3 records measurement data of the activation point determined by an activation clock time detected by the activation-point detection unit 9 and a measurement value of the inter-pole voltage at the activation clock time, and measurement data of the closing point determined by a closing clock time detected by the closing-time measurement unit 5, and can update the inter-pole withstand-voltage characteristic line f using the measurement data of the activation point and the measurement data of the closing point. Accordingly, RDDS (t) and the inter-pole withstand-voltage characteristic line f(t) can be updated so as to reflect the operation history of the circuit breaker 11, and the accuracy of the phase control can be improved more.

The function form approximating the inter-pole withstand-voltage characteristic line f is not limited to the quadratic function described above.

The configuration described in the above embodiment is only an example of the contents of the present invention. It is possible to combine the configuration with other publicly known techniques, and it is needless to mention that the present invention can be configured while modifying it without departing from the scope of the invention, such as omitting a part of the configuration.

REFERENCE SIGNS LIST

1 power switching control device
2 voltage measurement unit
3 target closing-clock-time determination unit
4 closing control unit
5 closing-time measurement unit
6 closing-time prediction unit
7 operating input condition
7*a* ambient temperature
7*b* control voltage
7*c* operation pressure
8 current measurement unit
9 activation-point detection unit
10 system power source
11 circuit breaker
12 main circuit
13*a*, 13*b* voltage transformer
14 current transformer
15*a* CPU
15*b* memory
15*c* input/output interface
16 inter-pole-voltage estimation unit
20 auxiliary switch.

The invention claimed is:

1. A power switching control device comprising:

a voltage measurement unit to measure a power-source-side voltage of a circuit breaker and a load-side voltage of the circuit breaker;

an inter-pole-voltage estimation unit to estimate a future inter-pole voltage from a measurement value of the power-source-side voltage and a measurement value of the load-side voltage;

a target closing-clock-time determination unit to set a target activation point of the circuit breaker on a waveform of an absolute value of the future inter-pole voltage, the target activation point being determined a target phase when activation of the circuit breaker is performed, set an inter-pole withstand-voltage characteristic line calculated from a rate of decrease of dielectric strength, the rate being provided by an absolute value of a temporal differentiation of the inter-pole withstand-voltage characteristic line and a function of a time, so that the inter-pole withstand-voltage characteristic line passes through the target activation point, and determine a clock time when the inter-pole withstand-voltage characteristic line becomes zero as a target closing clock time of the circuit breaker; and a closing control unit to control the circuit breaker so as to close the circuit breaker at the target closing clock time.

2. A power switching control device comprising:

a voltage measurement unit to measure a power-source-side voltage of a circuit breaker and a load-side voltage of the circuit breaker;

an inter-pole-voltage estimation unit to estimate a future inter-pole voltage from a measurement value of the power-source-side voltage and a measurement value of the load-side voltage;

a current measurement unit to measure a current of a main circuit connected to the circuit breaker;

an activation-point detection unit to detect an activation clock time from a current measurement value of the current measurement unit;

a closing-time measurement unit to measure a closing time of the circuit breaker by detecting a closing clock time of the circuit breaker;

a target closing-clock-time determination unit to set a target activation point of the circuit breaker on a waveform of an absolute value of the future inter-pole voltage, the target activation point being determined a target phase when activation of the circuit breaker is performed, set an inter-pole withstand-voltage characteristic line calculated from a rate of decrease of dielectric strength, the rate being provided by an absolute value of a temporal differentiation of the inter-pole withstand-voltage characteristic line and a function of a time, so that the inter-pole withstand-voltage characteristic line passes through the target activation point, and determine a clock time when the inter-pole withstand-voltage characteristic line becomes zero as a target closing clock time of the circuit breaker; and a closing control unit to control the circuit breaker so as to close the circuit breaker at the target closing clock time, wherein the target closing-clock-time determination unit records measurement data of an activation point determined by the activation clock time detected by the activation-point detection unit and a measurement value of an inter-pole voltage at the activation clock time, and measurement data of a closing point determined by the closing clock time detected by the closing-time measurement unit, and updates the inter-pole withstand-voltage characteristic line using the measurement data of the activation point and the measurement data of the closing point.

3. The power switching control device according to claim 2, wherein the inter-pole withstand-voltage characteristic line is initially provided by a linear function of a time.

4. The power switching control device according to claim 2, wherein the rate of decrease of dielectric strength is a function of a time.

* * * * *